United States Patent [19]

Teramura et al.

[11] Patent Number: 4,991,366

[45] Date of Patent: Feb. 12, 1991

[54] VIBRATION ISOLATING DEVICE

[76] Inventors: Akira Teramura, 29-10 Nukui 1-chome, Nerima-ku, Tokyo; Mitsuru Kageyama, 11-8, Katayama 3-chrome, Niiza-shi, Saitama; Arihide Nohata, 2-3, Higashigoken-cho, Shinjuku-ku, Tokyo, all of Japan

[21] Appl. No.: 233,230

[22] Filed: Aug. 18, 1988

[30] Foreign Application Priority Data

| | | | |
|---|---|---|---|
| Oct. 5, 1987 | [JP] | Japan | 62-249853 |
| Nov. 17, 1987 | [JP] | Japan | 62-288287 |
| Jun. 29, 1988 | [JP] | Japan | 63-159410 |
| Jun. 29, 1988 | [JP] | Japan | 63-159411 |

[51] Int. Cl.[5] ..... E04H 9/02

[52] U.S. Cl. ..... 52/167 R; 248/562

[58] Field of Search ..... 52/167; 248/562, 566, 248/569, 573, 575

[56] References Cited

U.S. PATENT DOCUMENTS

| | | | |
|---|---|---|---|
| 3,212,745 | 10/1965 | Lode | 52/167 X |
| 4,527,365 | 7/1985 | Yoshizawa et al. | 52/167 |
| 4,599,834 | 7/1986 | Fugimoto et al. | 52/167 |

*Primary Examiner*—David A. Scherbel
*Assistant Examiner*—Michele A. Van Patten
*Attorney, Agent, or Firm*—Barnes & Thornburg

[57] ABSTRACT

A vibration isolating device is provided with an isolator formed by an elastic member of laminated rubber and interposed between the base of a building and its foundation, for supporting the vertical load of the building and obtaining a long period dumping. A main dumper is disposed side by side with the isolator, for effectively damping relatively strong vibrations, and a sub-damper is disposed side by side with the isolator, for effectively dumping relatively weak vibrations. The vibration isolating device damps weak vibrations by the sub-damper and strong vibrations by the main damper, and hence gets effective damping of a wide range of vibrations from slight traffic vibrations to great earthquake shocks.

10 Claims, 9 Drawing Sheets

(a)

(b)

VIBRATION ISOLATING DEVICE

BACKGROUND OF THE INVENTION

1. Field of the Invention

The present invention relates to a vibration isolating device and, more particularly, to a vibration isolating device which not only protects building structures from sharp earthquake shocks but also effectively absorbs moderate and minor earthquake shocks and weak vibrations produced by external forces at ordinary times.

2. Description of the Prior Art

In recent years a variety of vibration isolating devices have been developed from the viewpoints of protecting personnel and objects accommodated in building structures from damage by earthquakes and saving construction materials for absorbing vibrations acting on the building structures themselves. FIG. 1 shows a typical prior art example, in which an isolator 3 formed by laminated rubber plates is disposed between the base 1 and the foundation 2 of a building and a plurality of main dampers 4 formed by steel rods are planted around the isolator 3 (although only one main damper is shown for the sake of brevity). This vibration isolating device is arranged so that when the base 1 and the foundation 2 of the building are displaced horizontally, by vibration, in excess of a predetermined value, the vibrational energy will be absorbed by elastic and plastic deformations of the main dampers 4, thereby damping vibrations which are transmitted to the building itself.

The relationship between shearing force Q acting on the main damper 4 and its horizontal displacement $\delta$ is along with hysteresis curves of its elastic and plastic deformations in FIG. 2. The segment OA indicates no-load displacement of the damper 4 until its top end portion strikes against one inner surface 5*a* of an engaging hole 5 in the base 1 of the building. The segment AB indicates an elastic deformation of the damper 4 and the segment BC its plastic deformation. The vibrational energy is mostly consumed by the plastic deformation of the damper 4 indicated by the segment BC. The segment CD indicates an elastic deformation of the damper 4 in a direction in which it is restored upon removal of the shearing force Q. The segment DE indicates no-load displacement of the damper 4 until its top end portion strikes against the other inner surface 5*b* of the engaging hole 5. The segment EF indicates an elastic deformation of the damper 4 and the segment FG its second plastic deformation. This plastic deformation also consumes vibrational energy and damps the vibration. The segment GH indicates an elastic deformation of the damper 4 in the direction of its restoration, the segment HI no-load deformation of the damper 4 until its top end portion hits again against the inner surface 5*a* of the engaging hole 5, and the segment IJ an elastic deformation similar to that indicated by the segment AB. The main damper 4 is disposed with its top end portion spaced apart from the engaging hole 5 as indicated by a, and hence will not engage the hole 5 when its displacement is small.

Accordingly, the above-described vibration isolating device is intended primarily to cope with relative strong shocks which are produced by great earthquakes, as shown in FIG. 3, and no particular consideration is paid to the vibration isolating or preventing action (hereinafter referred to as a vibration damping action) against vibrations by moderate and minor earthquakes and strong winds and vibration by traffic and similar slight vibrations. That is to say, in the case of a big earthquake which will cause the displacement of the main damper 4 to exceed $\delta_1$ in FIG. 2, the damping action will be performed by the plastic deformation of the damper 4, but when the displacement is below $\delta_1$, the damping action will not be effectively achieved.

At present so-called intelligent buildings are becoming increasingly popular, and many precision apparatus and equipment such as electronic computers are installed in such an intelligent building, and there is a strong demand for a vibration isolating device which is capable of effectively damping moderate and minor vibrations or shocks as well. Table 1 shows uses of quake-free buildings and damping capabilities required therefor.

TABLE 1

| Use | Ordinary quake-free buildings | Buildings in which electronic computers are installed | Buildings in which precision equipment are installed |
|---|---|---|---|
| Great Earthquake | | Shock waves should be suppressed. | |
| Moderate earthquake | | Appropriate attenuation should be maintained. | |
| Strong wind | | | |
| Vibration by traffic | | | Shock waves should be suppressed. |
| Slight vibration at ordinary times | | | |

It has also been suggested to dispose a buffer as of rubber in the engaging hole 5 of the base 1 so that medium and small vibrations in the horizontal direction by moderate and minor earthquakes and slight vibrations in the horizontal direction at ordinary times are absorbed and damped by the isolator and the buffer. However, our experiments have revealed that this method is still defective in that since the buffer is packed in a circular form in the limited gap between the steel rod of the main damper 4 and the building structure, there is severe limitations on the amount of buffer packed and the area contributing to the buffer function; therefore, no sufficient energy absorbing capability is provided.

SUMMARY OF THE INVENTION

It is an object of the present invention to provide a vibration isolating device which performs an effective damping action in the whole range of vibrations produced by external forces.

Another object of the present invention is to provide a vibration isolating device which effectively damps moderate and minor earthquake shocks and slight vibrations by external forces at ordinary times and protects the entire building structures from violent earthquakes.

In accordance with an aspect of the present invention, the vibration isolating device comprises an isolator which is formed of an elastic material such as rubber, interposed between the base and the foundation of a building structure, supports a relatively large load and obtains the building structure's damping period long, a main damper which is disposed in a side-by-side relation to the isolator and effectively damps relatively strong vibrations, and a sub-damper which is disposed in a side-by-side relation to the isolator and effectively damps relatively weak vibrations.

Such a vibration isolating device damps vibrations by traffic and similar weak shocks mainly by the sub-damper and severe shocks mainly by the main damper, and hence permits effective damping of a wide range of vibrations from weak traffic vibrations to great earthquake shocks. Accordingly, this vibration isolating device can be used not only to make building structures earthquake-resistant but also to protect, for instance, precision apparatus and equipment installed in an intelligent building from unwanted vibrations at ordinary times.

In accordance with another aspect of the present invention, the vibration isolating device comprises an elastic member which is interposed between a building structure and its foundation and supports the vertical load of the building structure and which is elastically deformed by a horizontal load to allow the relative horizontal displacement of the building structure and the foundation, a main damper which is disposed in a side-by-side relation to the elastic member and which when the relative displacement by the horizontal displacement exceeds a predetermined value, engages the building structure and the foundation and absorbs the horizontal vibrational energy, a sub-damper which is disposed in a side-by-side relation to the main damper and which when the relative displacement by the horizontal load is below the predetermined value, absorbs the horizontal vibrational energy by a bending deformation and shearing of a viscoelastic material, and pressure means for compressing the viscoelastic material of the sub-damper in the direction of gravity between the foundation and the building structure.

With the above vibration isolating device, since the viscoelastic material member of the sub-damper is interposed between the foundation and the building structure and compressed in the direction of gravity, there is no severe limitation on the space for the viscoelastic material; and so that the amount of energy absorbed by the viscoelastic material member can be increased by using a sufficient amount of viscoelastic material and increasing the area of shearing. This markedly improves the function of damping slight vibrations as by traffic at ordinary times and moderate and minor earthquake shocks.

Other objects, features and advantages of the present invention will become more apparent from the following description taken in conjunction with the accompanying drawings.

DESCRIPTION OF THE PREFERRED EMBODIMENTS

Figure 8:
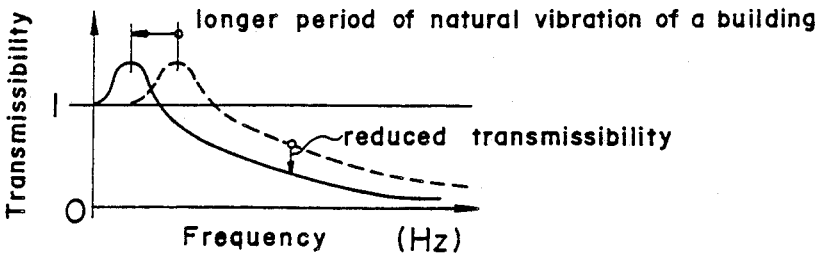
FIG. 8 is a graph showing the relationship between the frequency of vibration and transmissibility in an ordinary vibration isolating device.

To facilitate a better understanding of the present invention, a description will be given first, with reference to FIGS. 8 to 14, of the theoretical consideration of the principle on which the invention is based. FIG. 8 is a graph showing the relationship between the frequency of vibration of the ground and the rate at which the vibration is transmitted to a building (the transmissiblity), and it is seen from this graph that the transmissibility could be decreased by making the building structure's natural period longer. This could be done by reducing the rigidity of the damper of the vibration isolating device. In the case of vibration by a strong wind, however, since its cycle of vibration is long, it is necessary, for avoiding the resonance of the building with the vibration, to increase the rigidity of the damper or provide a means which has the function of preventing the movement of the damper (which means will hereinafter be referred to as a trigger). Table 2 shows requirements of the vibration isolating device for various kinds of vibrations.

TABLE 2

| | | Feature | Vibration isolating device | |
|---|---|---|---|---|
| | | | Rigidity | Measures |
| Large | large earthquake | — | low | Decrease rigidity of main and sub-dampers |
| ↑ | moderate earthquake | — | low | Decrease rigidity of main and sub-dampers |
| Dis-place-ment | strong wind | long cycle | high | Increase rigidity and provide a trigger |
| | minor earthquake | | low | Decrease rigidity of main and sub-dampers |
| ↓ | vibrations by traffic | high fre-quency ~about 100 Hz | low | Decrease rigidity of main and sub-dampers |
| Small | slight vibrations | | low | Decrease rigidity of main and sub-dampers |

The rigidity of the vibration isolating device could be reduced simply by preventing the damper from contributing to its rigidity; this could be achieved as is conventional, by providing a clearance between the top end portion of the damper and the engaging hole made in the base of the building or by forming the damper of a material of low rigidity.

The problem of resonance at the time of a high wind could be solved by increasing the rigidity of the damper to provide the trigger effect. In this instance, provision is made for producing the trigger effect only when the vibration of the building by a high wind approaches a tolerable limit, and on the other hand a damper of low rigidity is used to damp vibrations by other external forces. The reason for this is that the use of a damper of high rigidity for vibrations of a relatively high frequency will cause an increase in the transmissibility of the vibrations to the building.

Figure 9:
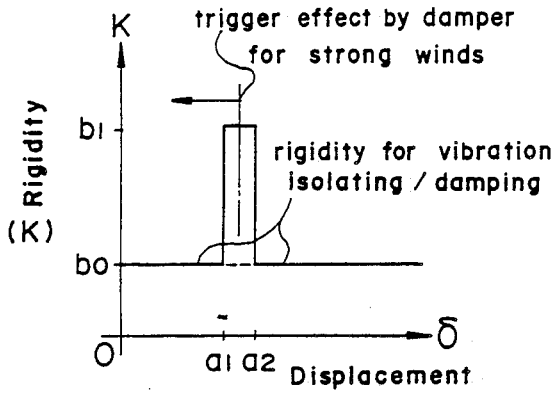
FIG. 9 is a graph showing a displacement-rigidity characteristic which indicates an ideal trigger effect in the case of a strong wind.
Figure 10:
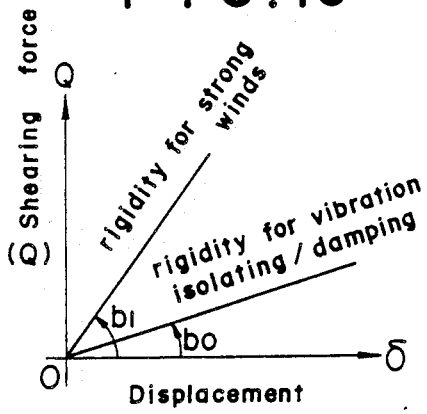
FIG. 10 is a graph in which the relationship depicted in FIG. 9 is shown in terms of the Q-δ characteristic.
Figure 11:
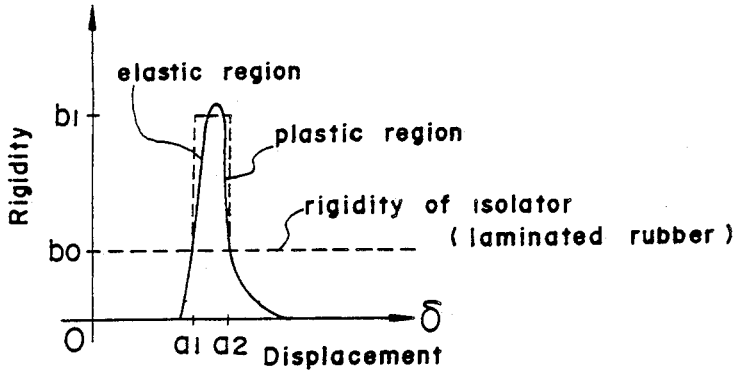
FIG. 11 is a graph showing a displacement-rigidity characteristic which indicates the actual trigger effect produced by a member such as a steel rod.

FIG. 9 shows an ideal trigger effect by the damper for strong winds and FIG. 10 illustrates the trigger effect in the form of the Q-δ curve. In this case, for an office building or dwelling structure, the upper limit of displacement (a1 to a2) which increases the rigidity of the damper itself or perform the trigger action by some other trigger means, must be selected such that the living conditions will not be adversely affected, and for a building in which an electronic computer or similar high precision apparatus is installed, the above-mentioned upper limit must be chosen taking into account the tolerable limit of displacement of each apparatus.

Where the damper is a steel rod or the like which has elastic and plastic regions, the displacement at the time of increasing the rigidity of the damper or the trigger action taking place is set such that when the displacement of the damper approaches a value a1, its rigidity rises from b0 up to b1 and when the displacement exceeds a value a2, the steel rod enters the plastic region and then gradually diminishes its damping effect, as shown in FIG. 11. It is possible, of course, to provide trigger means for producing such a trigger effect only.

Figure 12:
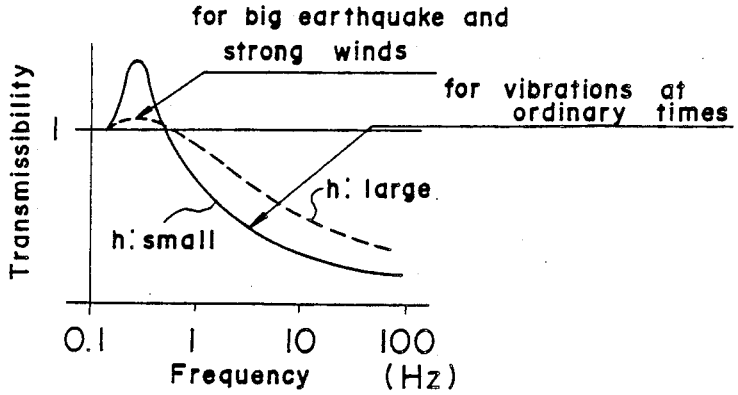
FIG. 12 is a graph showing a transmissibility-frequency characteristic.

Next, a description will be given of the damping action of the vibration isolating device in terms of its damping function. FIG. 12 shows that the damping effect varies with a damping constant h (= C/Cc, where C is a damping coefficient and Cc is a critical damping value). It will be understood from FIG. 12 that a large damping constant is preferable for reducing the resonance of a building at the times of severe earthquake shocks and high winds and that a small damping constant is preferable for higher frequencies, for example the vibration by traffic and similar slight shocks at ordinary times.

Figure 13:
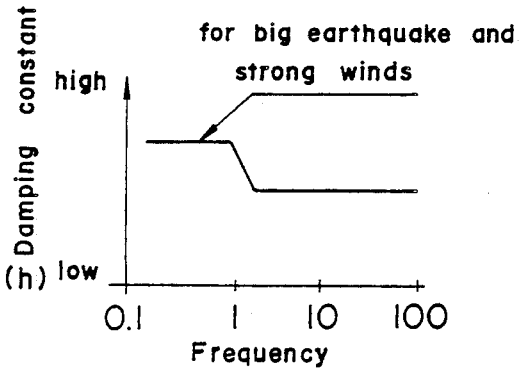
FIG. 13 is a damping constant-frequency characteristic.

Accordingly, as will be seen from FIG. 13 which shows the relationship between the frequency of vibration and the damping constant, it is preferable that the damping constant be somewhat smaller at the higher frequency side. Since it is considered that vibrations at ordinary times are high in frequency and small in displacement, FIG. 13 can be rewritten as depicted in FIG. 14 in which the abscissa represents displacement.

Figure 1:
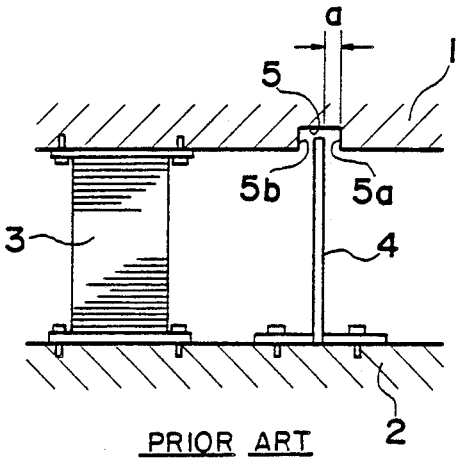
FIG. 1 is a sectional view of a conventional vibration isolating device which comprises a main damper and an isolator.
Figure 2:
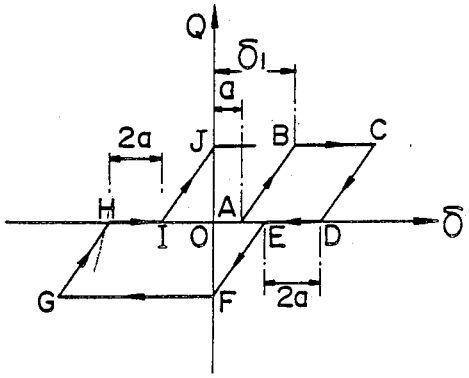
PRIOR ART FIG. 2
FIG. 2 shows a hysteresis curve of the device depicted in FIG. 1.
Figure 3:
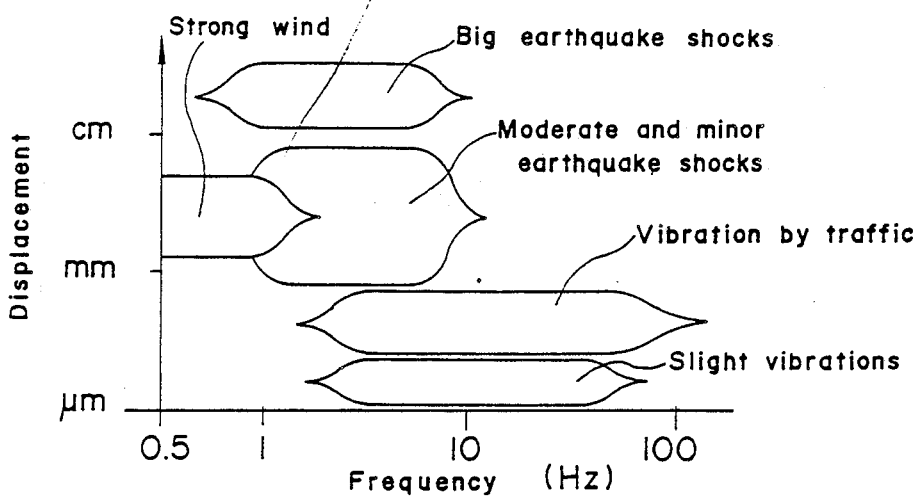
PRIOR ART FIG. 3
FIG. 3 is a graph showing the relationship between the frequency of vibration and the resulting displacement for which vibrations are considered to be isolated and prevented.
Figure 4:
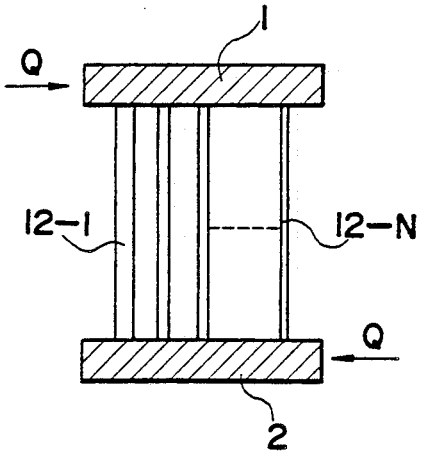
FIG. 4 is a side view schematically illustrating an embodiment of the vibration isolating device of the present invention.
Figure 14:
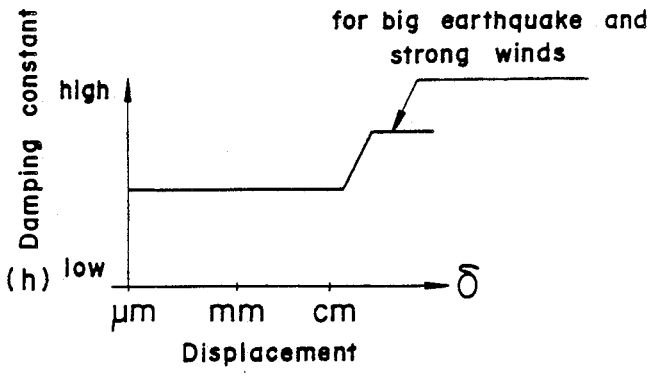
FIG. 14 is a damping constant-displacement characteristic.

Based on the above, the vibration isolating device which has such a damping characteristic as shown in FIG. 13 or 14 can be obtained by using, as a main damper, the conventional damper for severe earthquake shocks, in combination with a sub-damper for daily slight vibrations. FIG. 4 schematically illustrates sub-dampers 12-1 to 12-N for use in a first embodiment of the present invention. In FIG. 4 reference numeral 1 indicates the base of a building and 2 its foundation. In this case, a so-called floating-supported structure is employed in which the base 1 and the foundation 2 of the building are spaced apart by an isolator (which is similar to that shown in FIG. 1). Between the base 1 and the foundation 1 of the building a plurality of sub-dampers 12, which are steel rods or the like, are planted with their upper and lower ends secured to the base 1 and the foundation 2, respectively. The sub-dampers 12 are equal in length but different in diameter; their diameters are continuously varied from the thickest sub-damper 12-1 to the thinnest one 12-N.

Figure 5:
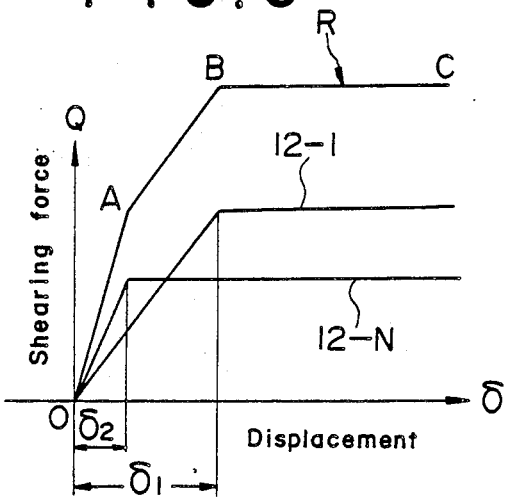
FIG. 5 is a graph showing its Q-δ characteristic.

The Q-δ curve, i.e. the shearing force-displacement characteristic, of the sub-damper 12 which is assumed to be formed by, for example, 12-1 and 12-N, for the sake of brevity, is such as indicated by the curve R in FIG. 5. The curve R is a combination of the Q-δ curves of the sub-dampers 12-1 and 12-N. The segment OA represents the elastic deformation of the sub-dampers 12-1 and 12-N, the segment AB the elastic deformation of only the sub-damper 12-1, and the segment BC the plastic deformation of the both sub-dampers 12-1 and 12-N.

Figure 6:
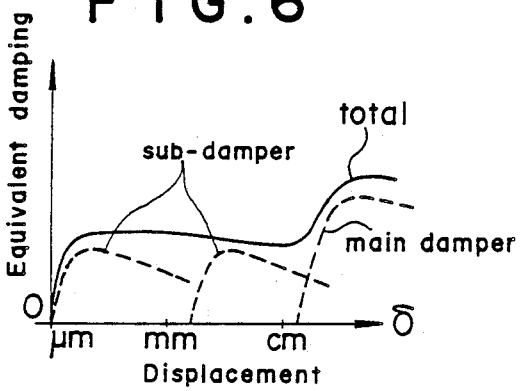
FIG. 6 is a graph showing its displacement-equivalent damping characteristic.

With the conventional vibration isolating device employing the main damper 4 alone, since the displacement $\delta_1$ of the damper 4 takes much deformation before it undergoes the plastic deformation, no damping action is performed for vibrations occurring in that interval. According to the present invention, however, the displacement region in which no damping action is performed can be decreased, because the sub-dampers 12-1 and 12-N undergo the plastic deformation in response to their displacements $\delta_1$ and $\delta_2$, respectively. FIG. 6 shows the relationship between the displacement of the damper and the resulting equivalent damping of vibration. In FIG. 6 the broken lines are displacement-damping characteristics of the main damper 4 and the sub-dampers 12-1 and 12-N and the full line is the displacement-damping characteristic of the vibration isolating device in its entirety. As is evident from FIG. 6, the vibration isolating device of this embodiment provides a required amount of equivalent damping over a wide range of displacement from small to large one.

Figure 7:
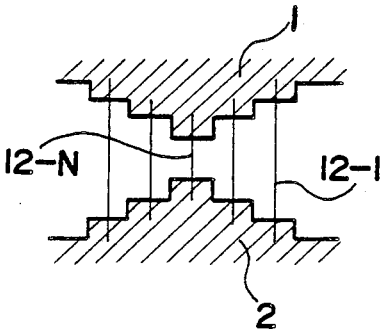
FIG. 7 is a side view schematically illustrating another embodiment of the vibration isolating device of the present invention.

The sub-dampers 12-1 to 12-N may also differ not only in diameter as shown in FIG. 4 but also in length as shown in FIG. 7. The point is to set a plurality of different displacement values at which the aforementioned plastic deformation is started, by combining sub-dampers of low to high rigidity.

Various dampers can be employed as the sub-damper, but the steel rod damper is advantageous over the other dampers in that it is highly reliable in operation, capable of producing the trigger effect at the time of a strong wind low-cost, highly durable and free from aging, and maintenance-free.

In addition to the steel rod damper, friction, oil and viscosity dampers may preferably be employed according to the intended use of each quake-free building (see Table 1).

Figure 15:
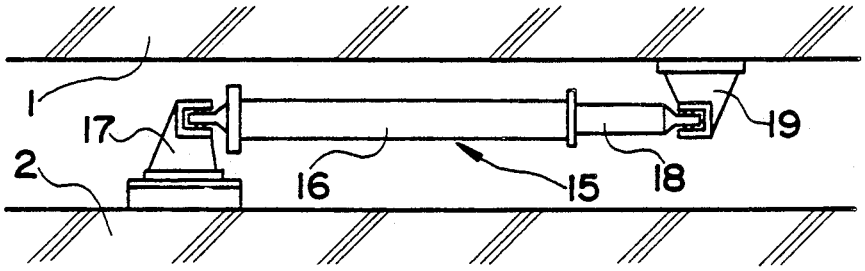
FIG. 15 is a side view showing a friction damper used as a sub-damper.
Figure 16:
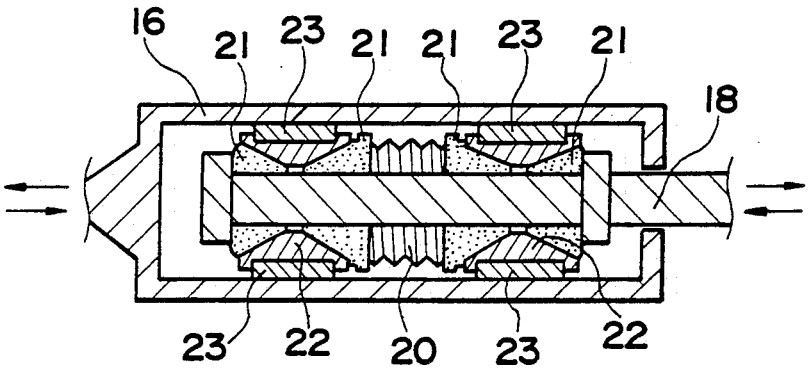
FIG. 16 is a sectional view illustrating the internal construction of the friction damper depicted in FIG. 15.

FIG. 15 shows the case where a friction damper 15 is used as the sub-damper. A cylinder 16 of the friction damper 15 is secured to the foundation 2 through a fixed block 17 and a piston rod 18 is secured to the base 1 of the building through a fixed block 19. The internal construction of the friction damper 15 is shown in FIG. 16, in which a pair of wedge members 21 is provided at either side of a belleville spring 20, a wedge sleeve 22 split into three parts circumferentially thereof is mounted on the piston rod 18 in surrounding relation to each pair of wedge member 21 and a slider 23 is slidably on the inner surface of the cylinder 16, mounted on the wedge sleeve 22.

In the friction damper 15 of such a construction, the force of the belleville spring 20 acts on the wedge members 21 to urge the wedge sleeves 22 in the radial direction thereof, by which a large frictional resistance is created between the sliders 23 and the cylinder 16, thus absorbing external forces.

Figure 17:
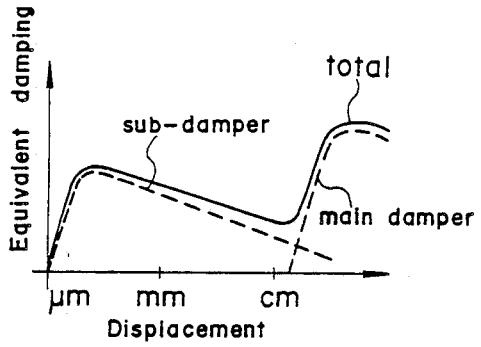
FIG. 17 is a displacement-equivalent damping characteristic of the friction damper used as the sub-damper.

FIG. 17 shows a displacement-equivalent damping characteristic of the above-mentioned damper employed, as a sub-damper, in combination with the main damper. When the frictional force of the friction damper is constant, the equivalent damping constant tends to be in inverse proportion to displacement. The friction damper is not limited specifically to the above-noted damper which utilizes sliding friction but may also be of the type utilizing rolling friction of bearings.

Figure 18:
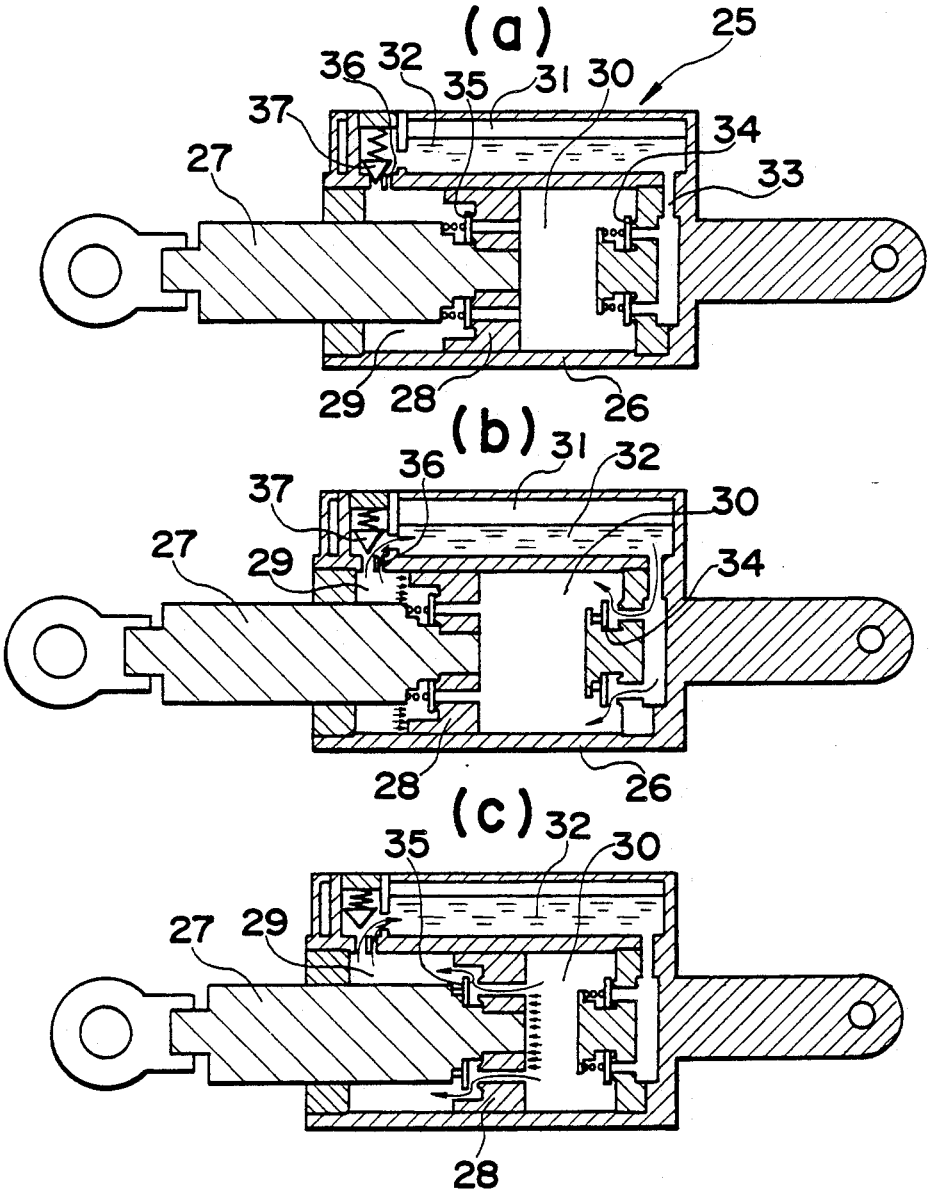
FIGS. 18(*a*) to 18(*c*) are sectional views illustrating an oil damper for use as the sub-damper.

FIG. 18(*a*) illustrates an oil damper 25 for use as the sub-damper. As is the case with the friction damper in FIG. 15, the oil damper has a cylinder 26 and a piston rod 27, which are secured to the foundation 2 and the base of a building. The piston rod 27 carries at one end a piston 28 which is slidably received in the cylinder 26 and divides the interior of the latter into left and right compartments 29 and 30 as depicted in FIG. 18(*a*). An oil tank 31 is mounted on the outside of the cylinder 26 and oil 32 stored in the oil tank 31 is permitted to flow into the right compartment 30 via a channel 33 and a first check valve 34, the right compartment 30 communicating with the left compartment 29 through a second check valve 35. The left compartment 29 and the oil tank 31 intercommunicate through a constant flow orifice 36 and a regulating valve 37.

In the oil damper 25 of such a construction as mentioned above, when the piston rod 27 is driven in the direction of contracting the left compartment 29, the oil in the left compartment 29 is compressed by the piston 28 and jetted out therefrom via the orifice 36 and into the tank 31 at a rate corresponding to the pressure applied to the oil, as shown in FIG. 18(*b*). When the moving speed of the piston 28 is high, the regulating valve 37 is opened, through which the oil gushes out from the left compartment 29 and into the oil tank 31. The internal pressure of the oil in the left compartment 29 acts the piston 28, creating a resistant force which corresponds to the force driving the piston rod 27 in the direction of contracting the left compartment 29. Thus, when the piston 28 slides in said direction the capacity of the right compartment 30 increases correspondingly and at the same time its internal pressure drops, with the result that the first check valve 34 is opened, through which the oil 32 is replenished from the tank 31 in an amount corresponding to the increased capacity of the right compartment 30.

When the piston rod 27 slides in the direction of expanding the left compartment 29 the oil in the right compartment 30 is compressed by the piston 28, and consequently the second check valve 35 is opened, through which the oil in the right compartment 30 flows into the left compartment 29 as shown in FIG. 18(*c*). As will be seen from FIG. 18(*c*), however, since the cross-sectional area of the left compartment 29 is smaller than that of the right compartment 30 by the cross-sectional area of the piston rod 27, internal pressures corresponding to the amount of the piston rod 27 driven into the cylinder 26 are produced in the left and right compartments 29 and 30, respectively.

As described above, an oil pressure is produced by the constant flow orifice 36 and the regulating valve 37 regardless of the direction in which the piston rod 27 is displaced.

Figure 19:
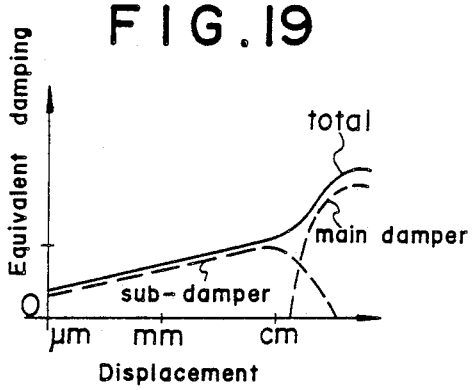
FIG. 19 is a displacement-equivalent damping characteristic of the oil damper used as the sub-damper.

FIG. 19 shows a displacement-equivalent damping characteristic of the above-mentioned oil damper when it is used, as a sub-damper, in combination with the main damper. Since the damping force of the oil damper is in proportion to the displacement of the piston rod 27 and the nth power of its displacement velocity, the damping constant tends to be in proportion to the displacement.

Figure 20:
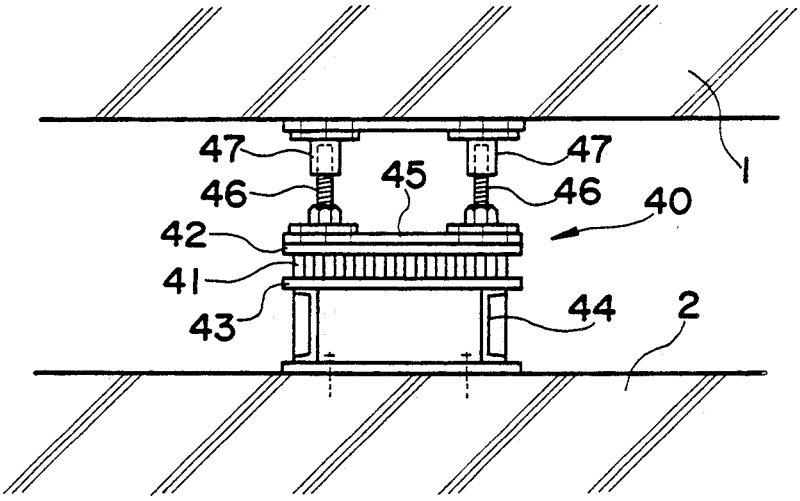
FIG. 20 is a side view illustrating an example of a viscosity damper for use as the sub-damper.

FIG. 20 illustrates, by way of example, a viscosity damper 40 for use as the sub-damper. In this example a number of solid columnar viscoelastic material members 41 are sandwiched between top and bottom panels 42 and 43; the bottom panel 43 is secured to the foundation 2 through fixed blocks 44; a sliding plate 45 is mounted on the upper surface of the top panel 42; threaded rods 46 are fixed to the sliding plate 45; and the threaded rods 46 are secured to the base 1 of a building by pressure adjusting nuts 47.

With the viscosity damper 40 of such a construction, the vibrational energy of a slight vibration transmitted to the foundation 2 is absorbed by shearing and bending deformation of the viscoelastic material members 41 of the sub-damper. When the shearing force which acts on the viscoelastic material members 41 due to a horizontal load exceeds the frictional force between the top panel 42 and the sliding plate 45, the top panel 42 slides along the underside of the sliding plate 45 so as to prevent excessive deformation of the viscoelastic material members 41.

Figure 21:
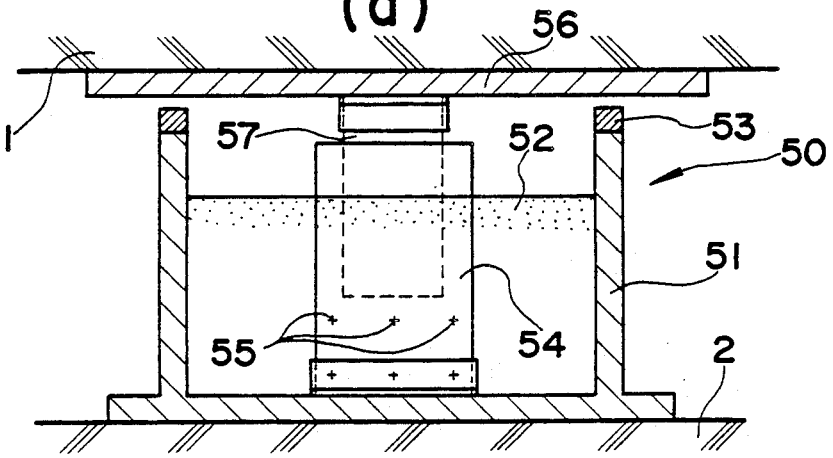
FIGS. 21(*a*) and 21(*b*) are sectional side and front views of another example of the viscosity damper for use in the present invention.
Figure 21:
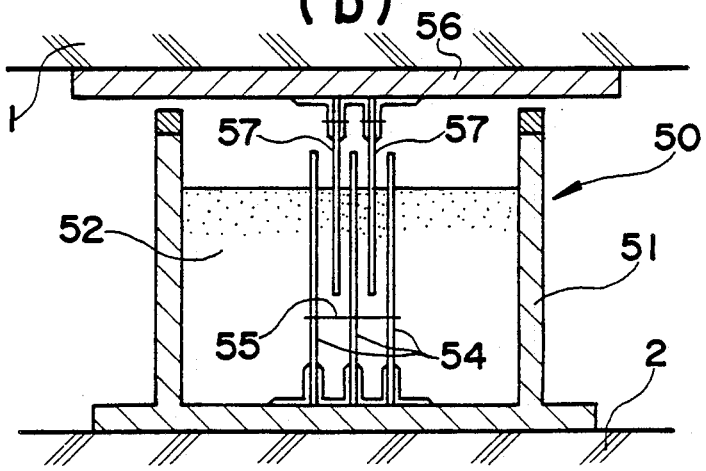

FIGS. 21(*a*) and 21(*b*) illustrate another example of the viscosity damper. In this viscosity damper identified by 50, a viscous material 52, such as silicon, is housed in a casing 51 open at the top, the bottom panel of the casing 51 is fixed to the foundation 2 of a building, and a cushioning material 53 is attached to the upper edge of the casing 51. In the casing 51 first thin iron plates 54 are planted at short intervals, fixed at the lower ends to the bottom of the casing 51 and coupled together by a coupling rods 55 so that they are spaced a predetermined distance apart. A panel 56 is disposed above the casing 51 at a predetermined distance therefrom, the panel 56 being fixed to the underside of the base 1 of the building. Second thin iron plates 57 fixed at the upper ends to the underside of the panel 56 are suspended therefrom, with their lower ends inserted between the first thin iron plate 54 and spaced a predetermined distance apart from the coupling rods 55 interconnecting the first thin iron plates 54.

Since the first and second thin iron plates 54 and 57 are immersed in the viscous material 52, the viscous material 52 between the thin iron plates 54 and 57 provides a viscous shearing resistance to a weak vibration transmitted to the foundation 2 and absorbs it.

Figure 22:
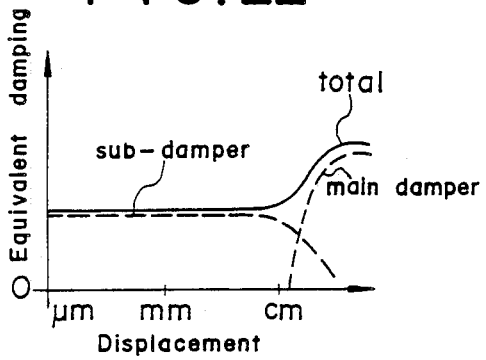
FIGS. 22 and 23 are graphs showing displacement-equivalent damping characteristics of the viscosity dampers depicted in FIGS. 20 and 21 used as sub-dampers, respectively.
Figure 23:
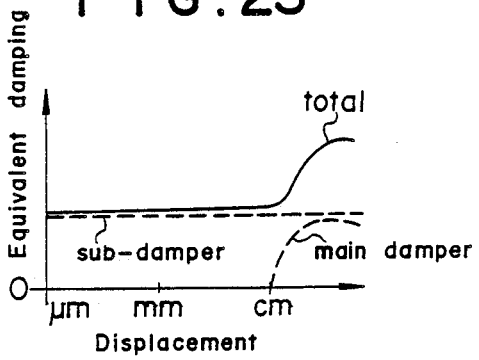

FIG. 22 shows the displacement-equivalent damping characteristic of the viscosity damper when it is used, as the sub-damper, in combination with the main damper. Since the damping force of the viscosity damper is in proportion to its displacement and displacement velocity, its damping constant tends to become constant. Incidentally, when the viscosity damper is sufficiently reliable in operation, the damping constant of the main damper may also be reduced as depicted in FIG. 23.

Figure 24:
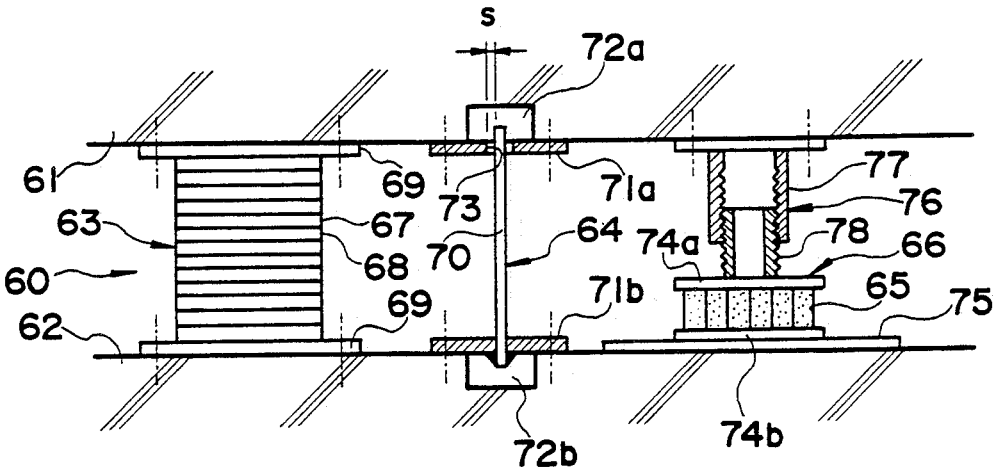
FIG. 24 is a side view illustrating another example of the viscosity damper for use in the present invention.
Figure 25:
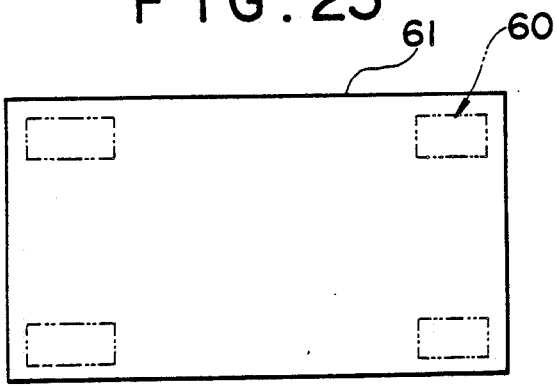
FIG. 25 is a plan view showing, by way of example, the position where each vibration isolating device of the present invention is located.

Next, a description will be given, with reference to FIGS. 24 to 26, an embodiment of the present invention which employs the viscosity damper as the sub-damper.

As shown, vibration isolating devices 60 interposed between a building structure 61 and its foundation 62 are disposed, for example, at four corners of the building structure 61.

Each vibration isolating device 60 comprises an elastic member 63 which supports the vertical load of the building structure 61 and is displaced horizontally by a horizontal load to permit the relative displacement of the building structure 61 and the foundation 62, a main damper 64 which engages the foundation 62 and the building structure 61 to absorb the horizontal vibrational energy when the above-mentioned relative horizontal displacement exceeds a predetermined value, and a sub-damper 66 which absorbs the horizontal vibrational energy by shearing and bending deformation of a viscoelastic material member (of a material having both viscous and elastic properties, such as resin or a mixture of resin and ferrite) 65 when the above relative displacement is below the predetermined value.

The elastic member 63 comprises flat rubber and steel plates 67 and 68 of the same shape, laminated alternately with each other, and end plates 69 attached to the top and bottom of the plate assembly. The elastic members 63 of each vibration isolating device 60 have a withstand load large enough to support the vertical load of the building structure 61 and the function that it is displaced by a horizontal load to absorb horizontal vibrations produced mainly at the time of an earthquake.

The main damper 64 comprises a steel rod 70 circular in cross section and a pair of mounting plates 71*a* and 71*b* attached to the upper and lower ends of the rod 70. The upper mounting plate 71*a* is fixed to the building structure 61 across a recess 72*a* made therein and the lower mounting plate 71*b* is similarly fixed to the foundation 62 across a recess 72*b* made therein.

The steel rod 70 has its lower end inserted through the lower mounting plate 71*b* and fixed to its underside by fusing and has its upper end loosely engaged with a through hole 73 of the upper mounting plate 71*a* with a play or clearance S (about 2 mm). When the relative horizontal displacement between the foundation 62 and the building structure 61 exceeds the above-said clearance S, the steel rod 70 will get into engagement with both of them so that the vibrational energy in the horizontal direction is effectively absorbed by its elastic and plastic deformation.

The sub-damper 66 is composed mainly of the aforementioned solid columnar viscoelastic material member 65, top and bottom iron plates 74*a* and 74*b* attached to upper and lower ends of the viscoelastic material member 65. A sliding iron plate 75 is interposed between the bottom plate 74*b* and the foundation 62 and fixed to the latter. A pressure means 76 is disposed between the top plate 74*a* and the building structure 61, for urging the viscoelastic material members 65 in the direction of gravity.

In this embodiment the pressure means 76 is a screw-jack-type member which comprises a tubular female screw member 77 fixed at the upper end to the building structure 61 and a tubular male screw member 78 threadably engaged with the female screw member 77 and fixed at the lower end by fusing to the top plate 74*a* centrally thereof. The pressure of the pressure means 76 can freely be adjusted by turning the male screw member 78 relative to the female screw member 77.

The viscoelastic material member 65 and the top and bottom plates 74*a* and 74*b* are firmly fixed to each other, for example, by vulcanization bonding. The bottom plate 74*b* is pressed by the force of the pressure means 76 against the sliding plate 75 and when a shearing force applied by a horizontal load to the viscoelastic material member 65 exceeds the frictional force between the bottom plate 74*b* and the sliding plate 75, the former will slide on the latter.

The viscoelastic material member 65 is molded in a solid columnar form approximately 5 to 10 cm in height and about several to several tens of centimeters in accordance with the allowable elongation rate of the viscoelastic material used. When the allowable elongation rate of the viscoelastic material is high, the material is molded into a single block dozens of centimeters in diameter. When the allowable elongation rate is low, the viscoelastic material member 65 is formed using a plurality of solid columnar elements each several centimeters in diameter so that the overall deformation capability of the viscoelastic material member 65 is increased by shearing and bending deformation of the individual columnar elements.

With such a vibration isolating device 60, weak vibrations which are produced by moving vehicles and transmitted to the foundation 62 are absorbed by the shearing and the bending deformation of the viscoelastic material member 65 of the sub-damper 66, by which the vibrational energy, which is transmitted to the building structure 61, is damped and buffered, thus minimizing the shaking of the building structure 61.

Moderate and minor earthquake shocks and similar vibrations are further absorbed and buffered also by the combination with the elastic deformation of the elastic member 63.

In case of a big earthquake which causes the relative horizontal displacement between the foundation 62 and the building 61 to exceed a predetermined value (defined by the afore-mentioned clearance S), the steel rod 70 of the main damper 64 gets into engagement with both of them and the vibrational energy is effectively absorbed by the elastic and the plastic deformation of the steel rod 70, thus protecting the whole building structure 61 from lateral sliding and similar movement.

In this embodiment, the viscoelastic material member 65 is interposed between the foundation 62 and the building structure 61 while being compressed by the pressure means 76 in the direction of gravity; and so that when the shearing force applied to a horizontal load to the viscoelastic material member 65 exceeds the frictional force acting between the bottom plate 74*b* and the sliding plate 75 in response to the pressure by the pressure means 76, the bottom plate 74*b* will slide on the sliding plate 75. Accordingly, at this time the damping force of the viscoelastic material member itself is decreased but the vibrational energy is converted into frictional heat during the sliding movement of the bottom plate 74*b* and hence is materially absorbed. The timing for starting the sliding movement of the bottom plate 74*b* can freely be adjusted by appropriately setting the pressure of the pressure means 76.

Further, since the viscoelastic material member 65 is interposed between the foundation 62 and the building structure 61 through the pressure means 76, the amount of viscoelastic material used and the area for the buffer function are not severely restricted in terms of space as in the prior art. Accordingly, it is possible to use a sufficient amount of viscoelastic material and provide a shearing area, thereby ensuring maximum absorption of vibrational energies of weak vibrations and moderate and minor earthquake shocks. For building structures weighing 2,000 to 3,000 tons, the shearing area of the viscoelastic material member 65 needs to be on the order of 400 to 500 $cm^2$; this will not present any particular problem in installing the sub-damper 66.

In this embodiment the pressure means 76 is the screw jack type and adjustable in pressure by turning the male screw member 78 relative to the female screw member 77, and hence is almost free from play. Furthermore, the pressure means 76 can easily be installed, as required, even after the completion of a quake-free building structure. In our experiment in which the vibration isolating device of this embodiment was attached to a quake-free frame having a weight on the order of 20 tons, a substantially uniform damping capability with the damping constant h=10 to 15% was obtained for displacements ranging from several microns to 2 cm or so. It has also been ascertained that the vibration isolating device is effective for damping weak vibrations at ordinary times and actual earthquakes.

While in the above embodiment the slid plate 75 of the sub-damper 66 is interposed between the foundation 62 and the bottom plate 74*b*, it is also possible to employ an arrangement in which the bottom plate 74*b* is fixed to the foundation 62 and the sliding plate 75 is disposed between the top plate 74*a* and the male screw member 78 so that when the shearing force applied by a horizontal load to the viscoelastic material member 65 exceeds the frictional force between the top plate 74*a* and the sliding plate 75, the top plate 74*a* slides horizontally on the underside of the sliding plate 75 so as to prevent the viscoelastic material member 65 from excessive deformation.

Figure 26:
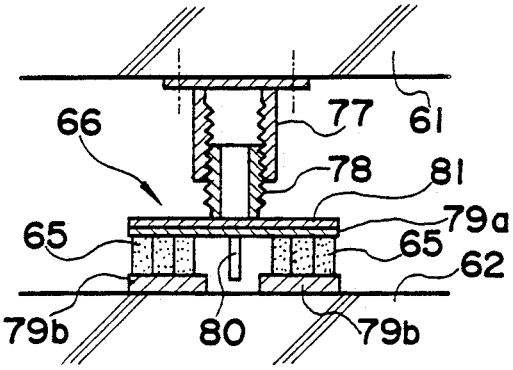
FIG. 26 is a sectional view illustrating still another example of the viscosity damper for use in the present invention.

Although in the above embodiment the sub-damper 66 is designed so that the sliding movement of the bottom plate 74*b* or top plate 74*a* on the sliding plate 75 protects the viscoelastic material member 65 from destruction by an excessive shearing force applied thereto, as described above, it is also possible to use such a sub-damper structure as shown in FIG. 26. A bottom plate 79*b* having a centrally disposed circular hole of a predetermined diameter is fixedly mounted on the foundation 62 and a hollow cylindrical viscoelastic material member 65 is disposed between the bottom plate 79*b* and a top plate 79*a* of the same size as the former. A stopper piece 80 is suspended from the underside of the top plate 79*a* so that it lies at the center of the hole of the bottom plate 79*b*. A plate member 81 is slidably mounted on the top surface of the top plate 79*a*. As in the case of FIG. 24, adjusted pressure is applied to the plate member 81 by a male screw member 78. It is a matter of course that the elastic member and the main damper, though not shown, are provided in the same manner as described previously with respect to FIG. 24.

With such a structure, when a shearing force greater than a predetermined value is applied to the viscoelastic material member 65 of the sub-damper 66, the stopper piece 80 abuts against the inner edge of the hole of the bottom plate 79*b*, preventing the viscoelastic material member 65 from excessive deformation. When a far greater shearing force is applied, the plate member 81 will slide horizontally on the top plate 79*a*.

It will be apparent that many modifications and variations may be effected from the scope of the novel concepts of the present invention.

What is claimed is:

1. A vibration isolating device comprising:

an isolator disposed between a base and a foundation of a building structure for supporting a vertical load of the building structure, the isolator being formed by an elastic member and adapted to permit a displacement of said building structure relative to said base in a horizontal direction;

a main damper disposed side by side with the isolator and adapted to positively absorb vibration energy for damping relatively large amplitude vibrations; and a sub-damper disposed side by side with the isolator and adapted to positively absorb vibration energy for damping relatively small amplitude vibrations.

2. A vibration isolating device comprising:

an isolator disposed between a base and a foundation of a building structure for supporting a vertical load of the building structure, the isolator being formed by an elastic member and adapted to permit a displacement of said building structure relative to said base in a horizontal direction;

a main damper disposed side by side with the isolator and adapted to effectively damp relatively large amplitude vibrations; and a sub-damper comprising a viscosity damper disposed side by side with the isolator and adapted to effectively damp relatively small amplitude vibrations.

3. The vibration isolating device of claim 2, wherein the viscosity damper comprises: a bottom plate mounted on the foundation of the building structure; a top plate mounted on the base of the building structure; a viscoelastic material member sandwiched between the top and the bottom plates, for absorbing vibrational energy transmitted to the foundation of the building structure by its shearing and bending deformation; and a sliding plate interposed between the base of the building structure and the top plate, for permitting sliding movement of the top plate relative to the base of the building structure so as to prevent excessive deformation of the viscoelastic material member by a horizontal load applied thereto.

4. The vibration isolating device of claim 3, wherein the viscoelastic material member is composed of a plurality of solid columnar viscoelastic material elements and the viscosity damper further includes pressure adjust means for adjusting the relative sliding frictional force between the sliding plate and the top plate.

5. A vibration isolating device comprising:

an elastic member interposed between a building structure and a foundation thereof, for supporting a vertical load of the building structure, the elastic member being elastically deformable by a horizontal load to permit a relative displacement of a building structure and a foundation in a horizontal direction;

a main damper disposed side by side with the elastic member, for engagement with the building structure and the foundation to absorb horizontal vibrational energy when their relative horizontal displacement exceeds a predetermined value;

a sub-damper disposed side by side with the elastic member, the sub-damper including a viscoelastic material member for absorbing, by its bending and shearing deformation, the horizontal vibrational energy when the relative horizontal displacement of the building structure and the foundation is below the predetermined value; and pressure means for pressurizing the viscoelastic material member in the direction of gravity between the building structure and the foundation.

6. The vibration isolating device of claim 5, wherein the elastic member includes an assembly of rubber and steel plates laminated alternately with each other and end plates attached to a top and bottom of a assembly, and wherein the elastic member supports the vertical load of the building structure on the foundation and is horizontally displaceable to permit the relative displacement of the building structure and the foundation to thereby absorb the vibrational energy applied thereto; the main damper includes an upper mounting plate fixed to the building structure across a recess made therein, a lower mounting plate fixed to the foundation across a recess made therein, and a circularly-sectioned steel rod having its lower end fixed to the lower mounting plate and its upper end portion inserted, with a clearance, into a hole made in the upper mounting plate, and when the relative horizontal displacement of the building structure and the foundation exceeds a predetermined value defined by the clearance, the steel rod gets into engagement with the building structure to absorb the horizontal vibrational energy by elastic and plastic deformations of the steel rod; and the sub-damper includes a solid columnar viscoelastic material member sandwiched between top and bottom plates attached to the top and bottom thereof, for absorbing the vibrational energy by its shearing and bending deformation when the relative horizontal displacement of the building structure and the foundation is below the predetermined value mainly; a sliding plate fixed to the foundation or the building structure and held in frictional contact with the bottom or top plate of the viscoelastic material member, for preventing the viscoelastic material member from its excessive deformation by sliding thereto to convert the horizontal vibrational energy into sliding frictional heat and hence absorb it, when a shearing force applied to the viscoelastic material member by the relative horizontal displacement of the building structure and the foundation exceeds the frictional force between the sliding plate and the top or bottom plate; and screw-jack-type pressure means composed of a female screw member and a male screw member threadably engaged therewith, for pressurizing the viscoelastic material member in the direction of gravity to provide adjustable frictional force between the top or bottom plate of the viscoelastic material member and the sliding plate.

7. The vibration isolating device of claim 6, wherein the sub-damper includes a hollow cylindrical viscoelastic material member sandwiched between a top plate attached to the top thereof and a ring-shaped bottom plate having a centrally-disposed hole attached to the bottom of the viscoelastic material member, and a stopper suspended from the top plate and extending down into the hole of the bottom plate, for engagement with the inner peripheral surface of the hole of the bottom plate to limit the deformation of the viscoelastic material member when the viscoelastic material member is subjected to an excessive horizontal load.

8. The vibration isolating device of claim 5, wherein the viscoelastic material member is formed of resin or mixture of resin and ferrite with both viscous and elastic properties.

9. The vibration isolating device of claim 5, wherein the viscoelastic material member is a solid columnar element high in allowable elongation rate.

10. The vibration isolating device of claim 5, wherein the viscoelastic material member is a combination of a plurality of solid columnar elements low in allowable elongation rate.

* * * * *

UNITED STATES PATENT AND TRADEMARK OFFICE

CERTIFICATE OF CORRECTION

PATENT NO. : 4,991,366

DATED : February 12, 1991

INVENTOR(S) : Masatoshi Takagi, et. al.

It is certified that error appears in the above-identified patent and that said Letters Patent is hereby corrected as shown below:

On the Title page

Item [19] Teramura et al should read -- Takagi et al--

Item [75] after "Inventors:" and before "akira Teramura", insert -- Masatoshi Takagi, Kashiwa; Hiroshi Okada, Sakado; Akira Teramura, Tokyo; Mitsuru Kageyama, Niiza; Arihide Nohata, Tokyo--.

Item [73] after "Tokyo, all of Japan", insert -- Assignee: Ohbayashi Corporation, Osaka, Japan In the Abstract, line 5, delete "dumping" and insert-- damping--therefor, and delete "dumper" and insert --damper--therefor; line 9, delete "dumping" and insert --damping-- therefor.

UNITED STATES PATENT AND TRADEMARK OFFICE

CERTIFICATE OF CORRECTION

PATENT NO. : 4,991,366

DATED : February 12, 1991

INVENTOR(S) : Masatoshi Takagi, et. al.

It is certified that error appears in the above-identified patent and that said Letters Patent is hereby corrected as shown below:

Column 13, line 30, delete "a" (second occurrence) and insert --the--therefor.

Signed and Sealed this

Twenty-sixth Day of January, 1993

*Attest:*

DOUGLAS B. COMER

*Attesting Officer*

*Acting Commissioner of Patents and Trademarks*